US007278354B1

(12) United States Patent
Langan et al.

(10) Patent No.: US 7,278,354 B1
(45) Date of Patent: Oct. 9, 2007

(54) SHOCK INITIATION DEVICES INCLUDING REACTIVE MULTILAYER STRUCTURES

(75) Inventors: Timothy Langan, Catonsville, MD (US); Michael A. Riley, Towson, MD (US)

(73) Assignee: Surface Treatment Technologies, Inc., Halethrope, MD (US)

( * ) Notice: Subject to any disclaimer, the term of this patent is extended or adjusted under 35 U.S.C. 154(b) by 104 days.

(21) Appl. No.: 10/855,298

(22) Filed: May 27, 2004

Related U.S. Application Data

(63) Continuation-in-part of application No. 10/839,638, filed on May 5, 2004.

(60) Provisional application No. 60/473,509, filed on May 27, 2003.

(51) Int. Cl.
*F42B 1/032* (2006.01)

(52) U.S. Cl. ..... 102/306; 102/307; 102/476

(58) Field of Classification Search ..... 102/306, 102/307, 308, 309, 310, 475, 476, 275.11, 102/205; 149/14, 15, 16, 37; 428/607, 615, 428/548; 427/455; 89/36.02, 36.17
See application file for complete search history.

(56) References Cited

U.S. PATENT DOCUMENTS 3,135,205 A 6/1964 Zwicky
3,235,005 A 2/1966 Delacour
3,726,643 A 4/1973 Merzhanov et al.
3,961,576 A * 6/1976 Montgomery, Jr. ..... 102/491
4,161,512 A 7/1979 Merzhanov et al.
4,431,448 A 2/1984 Merzhanov et al.
4,498,367 A 2/1985 Skolnick et al.
4,557,771 A 12/1985 Bencz et al.
4,710,348 A 12/1987 Brupbacher et al.
4,766,813 A 8/1988 Winter et al.
4,783,379 A * 11/1988 Wickersham et al. ..... 428/607
4,836,982 A 6/1989 Brupbacher et al.
4,915,905 A 4/1990 Kampe et al.
4,917,964 A 4/1990 Moshier et al.
4,958,569 A 9/1990 Mandigo
5,015,534 A 5/1991 Kampe et al.
5,090,324 A 2/1992 Bocker et al.
5,098,487 A 3/1992 Brauer et al.
5,119,729 A 6/1992 Nguyen
5,175,391 A 12/1992 Walters et al.
5,266,132 A * 11/1993 Danen et al. ..... 149/15
5,413,048 A 5/1995 Werner et al.
5,466,537 A * 11/1995 Diede et al. ..... 428/548
5,467,714 A * 11/1995 Lund et al. ..... 102/284
5,490,911 A * 2/1996 Makowiecki et al. .. 204/192.15
5,505,799 A * 4/1996 Makowiecki ..... 149/15
5,538,795 A 7/1996 Barbee, Jr. et al.
5,606,146 A * 2/1997 Danen et al. ..... 149/15
5,656,791 A 8/1997 Reese et al.
5,773,748 A * 6/1998 Makowiecki et al. ..... 102/205

(Continued)

*Primary Examiner*—James S. Bergin
(74) *Attorney, Agent, or Firm*—Alan G. Towner, Esq.; Pietragallo Bosick & Gordon, LLP

(57) ABSTRACT

The invention provides shock initiation devices comprising multilayer structures with constituent layers that undergo an exothermic self-propagating reaction once initiated by shock. The multilayer structures may be used as components in shaped charges, EFP devices, warheads, munition casings, interceptors, missiles, bombs, and other systems. The reactive layer materials may be selected based on required structural properties, density and reaction temperature.

15 Claims, 8 Drawing Sheets

U.S. PATENT DOCUMENTS 5,852,256 A * 12/1998 Hornig ..... 102/473
5,859,383 A 1/1999 Davison et al.
5,939,664 A 8/1999 Kapoor
5,547,715 A 11/1999 Barbee, Jr. et al.
6,012,392 A 1/2000 Norman et al.
6,021,714 A 2/2000 Grove et al.
6,152,040 A 11/2000 Riley et al.
6,446,558 B1 9/2002 Peker et al.
6,530,326 B1 3/2003 Wendt, Jr. et al.
6,534,194 B2 3/2003 Weihs et al.
6,564,718 B2 5/2003 Reese et al.
6,588,344 B2 7/2003 Clark et al.
6,596,101 B2 7/2003 Weihs et al.
6,634,300 B2 10/2003 Reese et al.
6,655,291 B2 12/2003 Pratt et al.
6,736,942 B2 5/2004 Weihs et al.
6,863,992 B2 3/2005 Weihs et al.
6,881,284 B2 * 4/2005 Makowiecki et al. .... 149/109.6
6,962,634 B2 * 11/2005 Nielson et al. ..... 149/19.3
6,991,855 B2 1/2006 Weihs et al.
6,991,856 B2 1/2006 Weihs et al.
2001/0046597 A1 11/2001 Weihs et al.
2002/0182436 A1 12/2002 Weihs et al.
2003/0164289 A1 9/2003 Weihs et al.
2004/0060625 A1 * 4/2004 Barbee et al. ..... 149/15
2005/0051607 A1 3/2005 Wang et al.
2005/0082343 A1 4/2005 Wang et al.
2005/0136270 A1 6/2005 Besnoin et al.
2006/0068179 A1 3/2006 Weihs et al.

* cited by examiner

SHOCK INITIATION DEVICES INCLUDING REACTIVE MULTILAYER STRUCTURES

CROSS-REFERENCE TO RELATED APPLICATIONS

This application claims the benefit of U.S. Provisional Patent Application Ser. No. 60/473,509 filed May 27, 2003, which is incorporated herein by reference.

This application is a continuation-in-part of U.S. application Ser. No. 10/839,638 filed May 5, 2004, which is incorporated herein by reference.

GOVERNMENT CONTRACT

The United States Government has certain rights to this invention pursuant to Contract No. DASG-60-02-0171 awarded by the U.S. Army Space Missile Defense Command, Contract No. N68936-03-C-0019 awarded by the U.S. Navy, and Contract No. F08630-02-SC-0048 awarded by the U.S. Air Force.

FIELD OF THE INVENTION

The present invention relates to reactive devices, and more particularly relates to shock initiation devices such as reactive shaped charges, munitions casings, kinetic interceptors and the like, which include reactive multilayer structures.

BACKGROUND INFORMATION

Exothermic warhead technology has been shown to produce benefits by combining kinetic and thermal energies in the attack process (Bailey and Nooker, "Coruscative Liner Materials", Applied Physics Lab, 1963). Later studies by Zaviatsanos and Riley (1990) further confirmed the benefits of reactive intermetallic systems as fragmenting warhead systems. Exothermic or pyrophoric materials have also been investigated for compound target effects, such as the initiation of fuels and other combustibles. However, the radial dispersion of thermal energy of conventional reactive intermetallic materials is low, and the materials are subject to shielding. For conventional penetrators to perform optimally, key characteristics include material density, fracture toughness and grain size/orientation. In some existing systems, grain size can be on the order of millimeters. This large grain structure produces orientation anomalies, e.g., from the pancake forging process, and is in part responsible for a high rejection rate of forged liner products.

Problems with conventional reactive intermetallic systems include their low density, their inability to fully react, and their lack of physical strength necessary to survive the high-vibration environments of military hardware. This is due to the fact that approaches to date have utilized pressed powders. Many of these systems have failed either in production, or through vibration testing, both of which can result in frictional initiation. As reactive powders are pressed, each powder element has trapped gas on it, typically oxides. When reacted in a highly constrained manner, the gases create very high, localized pressures, which tend to tear the pressed body apart, reducing the amount of large mass available to impart thermal damage. Furthermore, long time exposure of powder metallurgy materials in storage makes them susceptible to moisture and vibration, and their lack of inherent mechanical strength has a direct impact on the fragment size available for target interaction. In addition, pyrophoric solid metals that rapidly oxidize when explosively deformed do not meet their anticipated benefits, since burning is typically a surface phenomenon, and the bulk of these incendiary fragments are only slightly elevated in temperature.

The present invention overcomes these problems by incorporating reactive materials in multilayer structures, which have densities that approach theoretical values, and which have good structural integrity and good mechanical properties.

SUMMARY OF THE INVENTION

The invention provides devices comprising reactive multilayers which undergo an exothermic reaction upon shock initiation. The shock initiation devices may be shaped charges, EFP devices, warheads, munitions casings, interceptors, missiles, bombs, rocket propelled grenades and other systems. The reactive multilayer structures of the devices may be selected based on required structural properties, density and reaction temperature.

An aspect of the present invention is to provide a shock initiation device comprising a reactive multilayer structure including repeating layers of reactive components, and means for shock initiation of the reactive multilayer structure.

Another aspect of the present invention is to provide a method of making a shock initiation device. The method includes depositing layers of reactive materials onto a substrate to form the reactive multilayer structure, and incorporating the reactive multilayer structure in a shock initiation device.

A further aspect of the present invention is to provide a method of reacting a multilayer structure. The method includes providing a reactive multilayer structure comprising repeating layers of reactive components, and initiating reaction of the reactive components by subjecting the components to shock.

These and other aspects of the present invention will be more apparent from the following description.

DETAILED DESCRIPTION

Figure 1:
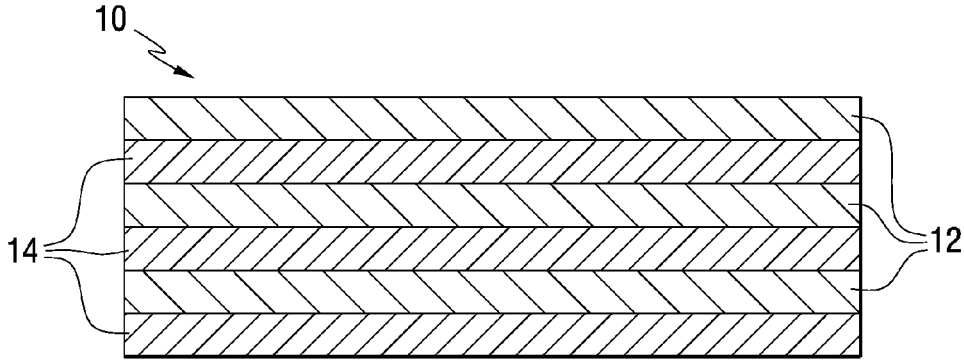
FIG. 1 schematically illustrates a reactive multilayer structure comprising alternating layers of reactive components which may be used in a shock initiation device in accordance with an embodiment of the present invention.

The present invention provides reactive devices including reactive multilayer structures which may be ignited by shock initiation. As used herein, the term "shock initiation device" means a device or component thereof which undergoes a substantially simultaneous or bulk exothermic reaction when subjected to sufficient shock. Reactive components of the device undergo a substantially simultaneous exothermic reaction upon shock initiation. The shock may be generated by means such as explosives, impact with another object or target, or the like. The device may be arranged such that shock initiation results in an exothermic wave front which propagates in a direction substantially perpendicular to the reactive layers, thereby facilitating bulk or substantially simultaneous initiation of the multilayer structure. Typical shock initiation devices may disperse the reacted or reacting material in a desired manner, such as a unidirectional or omnidirectional pattern.

The shock initiation devices include reactive multilayer structures comprising at least two layers of reactive components. As used herein, the term "reactive components" means materials that exothermically react with each other upon shock initiation and which produce a sufficiently high heat of reaction. Elevated temperatures of at least 1,000° C. are typically achieved, for example, at least 2,000° C. In one embodiment, the reactive components may comprise elements that exothermically react to form intermetallics or ceramics. In this case, the first reactive component may comprise, for example, Ti, Ni, Ta, Nb, Mo, Hf, W, V, U and/or Si, while the second reactive component may comprise Al, Mg, Ni, C and/or B. Typical materials formed by the reaction of such reactive components include $TiAl_x$ (e.g., TiAl, $TiAl_3$, $Ti_3Al$), NiAl, $TaAl_3$, $NbAl_x$, SiAl, TiC, $TiB_2$, VC, WC and VAl. Thermite powders may also be suitable. In this case, one of the reactive components may comprise at least one metal oxide selected from $Fe_xO_y$, $Ni_xO_y$, $Ta_xO_y$, $TiO_2$, $CuO_x$ and $Al_2O_3$, and another one of the reactive components may comprise at least one material selected from Al, Mg, $N_1$ and $B_4C$. In one embodiment, one of the reactive components may comprise $TiO_2$, $Al_2O_3$, $Fe_3O_4$, $SiO_2$ and/or $NiO_2$, and another of the reactive components may comprise Al, Fe, $N_1$, $B_2O_3$ and/or $TiO_2$. More than two reactive components may be used, e.g., Al/Ni/NiO, Ni/Al/Ta, etc.

By proper selection of components, it is possible to form an unreacted layered structure with a bulk composition that will chemically equal an intermetallic or ceramic compound. The unreacted body is a substantially fully dense solid multilayer structure complete with mechanical properties that permit its use as a load bearing material. Under proper shock conditions (explosive or other), the materials undergo an exothermic reaction. The composition and thickness of each layer is selected such that bulk or substantially simultaneous initiation of the entire structure occurs upon shock initiation. In many types of shock initiation devices incorporating reactive multilayers, the reacted or reacting material is dispersed in a desired manner, such as a unidirectional or omnidirectional dispersion pattern.

The present reactive multilayer structures can differ from compressed powder materials because there is substantially no impurity outgassing. In addition, pressed powder compositions tend to rapidly disperse into powders after shock initiation. The reactive multilayer structures also differ from pyrophoric metals like zirconium because the entire body reaches its peak exotherm, not just the exposed edges. This permits the fragmented sections of the body to maintain thermal output levels much longer than either powder reactants or individual pyrophoric metals. Given the ability to control reactions via the forming process, a great degree of tailorability may be achieved with the present reactive multilayers.

A partial list of candidate reactive layer materials is shown in Table 1.

TABLE 1

| Alloy Components | Heat of Reaction | Fluence | Peak Reaction Temperature |
|---|---|---|---|
| 2Si + V | 700 cal/g | 2400 cal/cm$^3$ | 3341 K |
| 3Si + 5Ti | 428 cal/g | 1590 cal/cm$^3$ | 2548 K |
| 5Nb + 3Si | 222 cal/g | 1390 cal/cm$^3$ | 2518 K |
| Al + Ni | 330 cal/g | 1710 cal/cm$^3$ | 2362 K |
| Al + Co | 307 cal/g | 1590 cal/cm$^3$ | 2195 K |
| 2Si + Zr | 258 cal/g | 1040 cal/cm$^3$ | 1988 K |
| 2Al + Zr | 267 cal/g | 1130 cal/cm$^3$ | 1923 K |
| 2Si + Ti | 308 cal/g | 967 cal/cm$^3$ | 1913 K |
| Mo + 2Si | 187 cal/g | 855 cal/cm$^3$ | 1854 K |
| Ni + Si | 235 cal/g | 1140 cal/cm$^3$ | 1838 K |
| 2Si + Ta | 120 cal/g | 851 cal/cm$^3$ | 1781 K |
| 5Al + 2Co | 277 cal/g | 1110 cal/cm$^3$ | 1755 K |
| Co + Si | 299 cal/g | 1450 cal/cm$^3$ | 1733 K |
| 5Cr + 3Si | 226 cal/g | 847 cal/cm$^3$ | 1671 K |
| 2Al + Ti | 314 cal/g | 1100 cal/cm$^3$ | 1643 K |
| Al + Ti | 240 cal/g | 872 cal/cm$^3$ | 1597 K |
| 3Al + Fe | 278 cal/g | 1020 cal/cm$^3$ | 1407 K |

FIG. 1 schematically illustrates a reactive multilayer structure 10 comprising alternating layers of a first reactive component material 12 and a second reactive component material 14 which may be used in shock initiation devices of the present invention. The layers 12 and 14 typically have thicknesses of from about 10 nanometers to about 0.5 mm, preferably from about 10 nanometers to about 1 micron. The layer thicknesses are selected such that the multilayer structure 10 is capable of substantially simultaneous or bulk initiation when subjected to selected shock conditions. The total thickness of the multilayer structure 10 is typically from about 100 nanometers to about 25 mm, preferably from about 1 micron to about 1 mm.

Figure 2:
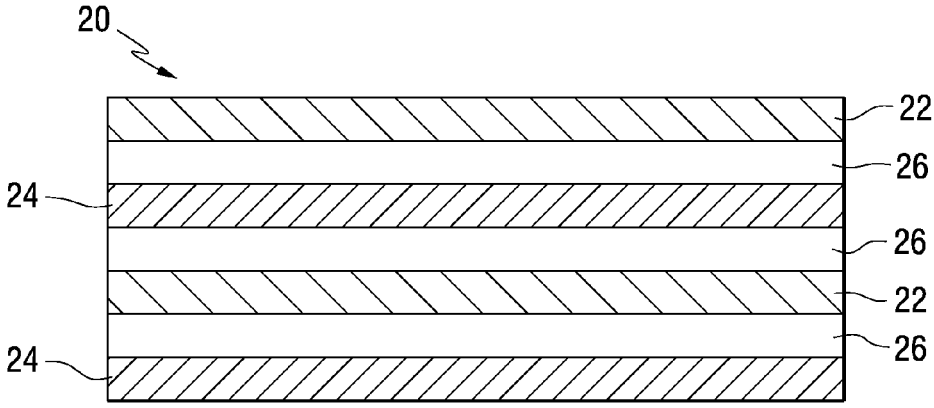
FIG. 2 schematically illustrates a reactive multilayer structure comprising layers of reactive components separated by layers of inert material which may be used in a shock initiation device in accordance with another embodiment of the present invention.

FIG. 2 illustrates a reactive multilayer structure 20 comprising layers of first and second reactive components 22 and 24, separated by layers of inert material 26 which may be used in shock initiation devices of the present invention. The reactive component layers 22 and 24 may have thicknesses as described above. The inert material layers 26 may comprise any suitable material such as glasses and ceramics, and may be thermally sprayed, or may be deposited by any other suitable technique. The layers 26 may also comprise an interdiffusion zone (IDZ) between the reactive component layers 22 and 24. The thickness of each inert layer 26 is typically from about 10 nanometers to about 1 mm, preferably from about 10 nanometers to about 10 microns.

Figure 3:
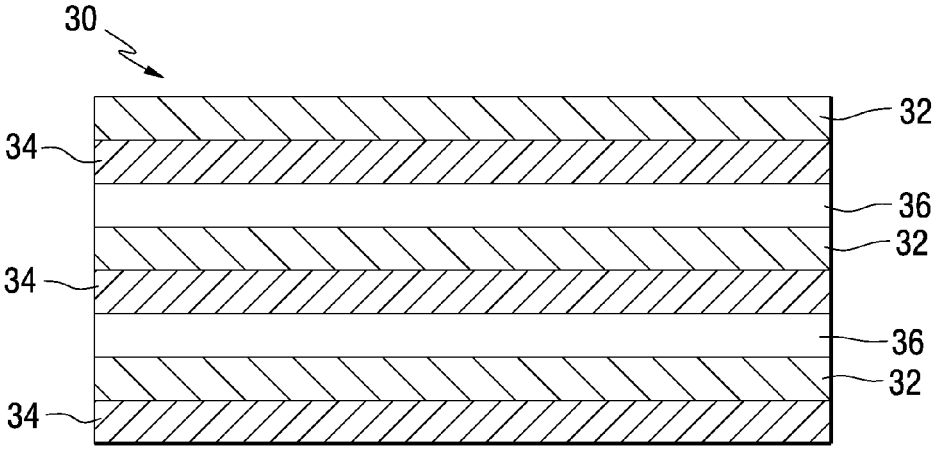
FIG. 3 schematically illustrates a reactive multilayer structure comprising pairs of reactive component layers separated by layers of inert material which may be used in a shock initiation device in accordance with a further embodiment of the present invention.

FIG. 3 illustrates a reactive multilayer structure 30 comprising pairs of reactive component layers 32 and 34 having thicknesses as described above, separated by layers of inert material 36 having thicknesses as described above which may be used in shock initiation devices of the present invention.

Figure 4:
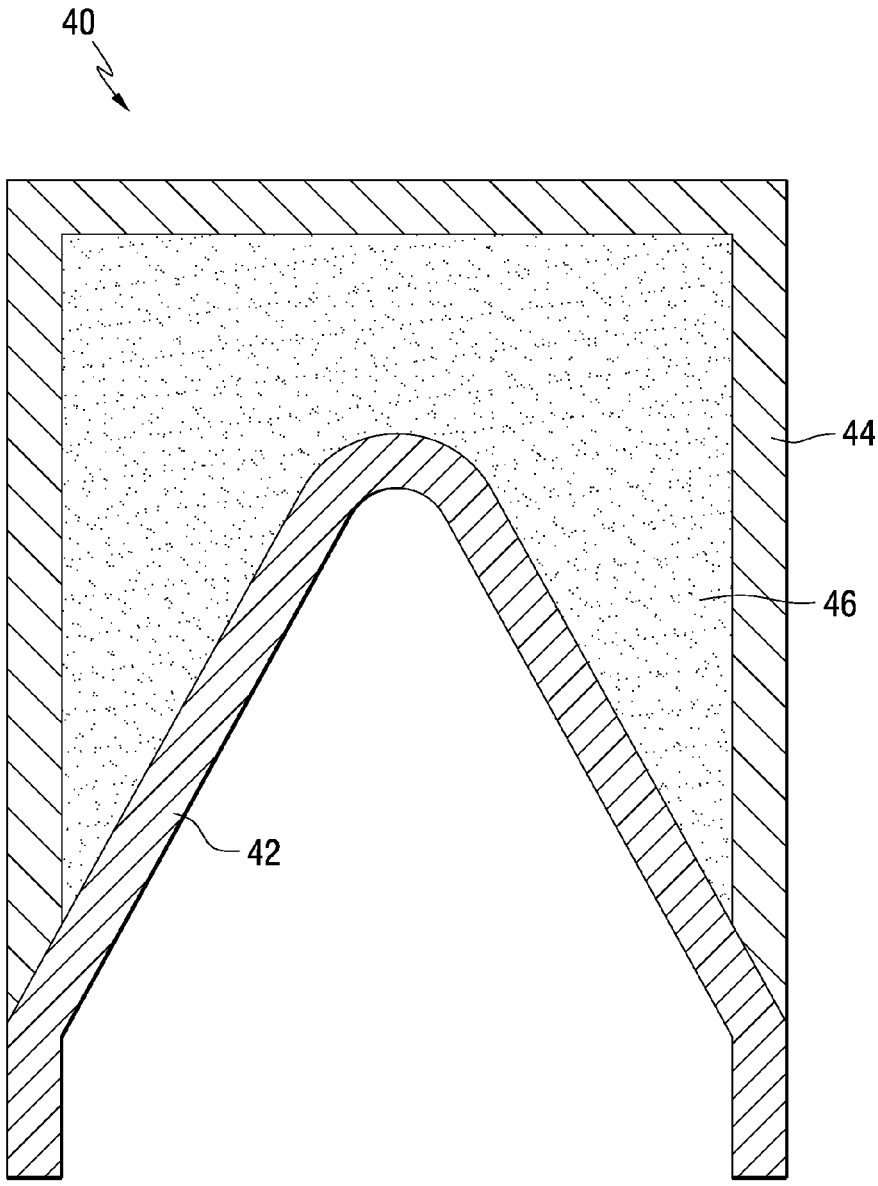
FIG. 4 is a partially schematic cross-sectional view of a reactive shaped charge including a reactive multilayer structure in accordance with an embodiment of the present invention.

FIG. 4 is a sectional view of a shock initiation device in the form of a shaped charge 40 including a reactive multilayer shaped charge liner 42 in accordance with an embodiment of the present invention. The shaped charge 40 includes a casing 44 made of any suitable material such as aluminum, steel or fiber-wrap composite filled with an explosive material 46 made of any suitable material such as PETN, Octol or C-4. In the embodiment shown in FIG. 4, the reactive shaped charge liner 42 is substantially cone-shaped. The height of such a cone-shaped liner typically ranges from about 1 to about 100 cm. The diameter of the cone-shaped liner, measured at its base, typically ranges from about 1 to about 100 cm. Although a cone-shaped liner is shown in FIG. 4, other shapes may be used, such as spheres, hemispheres, cylinders, tubes, lines, 1-beams and the like. In addition, the present reactive multilayer structures may be used in other shock initiation devices including munitions casings, kinetic interceptors, rocket propelled grenades and the like. In accordance with embodiments of the present invention, the reactive multilayers comprise structural or load-bearing components of such devices.

The multilayer structures may be formed by techniques such as vapor deposition, rolling of foils or forging. Alternatively, the multilayer structures may be formed by thermal spraying techniques such as those disclosed in U.S. patent application Ser. No. 10/839,638 filed May 5, 2004, which is incorporated herein by reference. Various vapor deposition techniques such as magnetron sputtering, chemical vapor deposition, electron-beam physical vapor deposition (PVD) and laser assisted PVD can be used to form the structural multilayers. Deposition parameters are selected to control the thickness of the layers and the interdiffusion zone (IDZ) between the layers. The present multilayer structures can be fabricated such that the initiation wave front propagates substantially perpendicular to the reactive layers. Thus, the entire structure can be initiated substantially simultaneously.

The energy required to initiate the exothermic reaction and the rate of the reaction are directly related to the physical properties, e.g., thickness, and the composition of the IDZ. The sensitivity for shock initiation of the exothermic reaction is defined based on the characteristics of the IDZ. The IDZ may be modified by varying the deposition parameters, changing the characteristics of the deposition substrate, the use of inert layers, or through post deposition thermal processing of the multilayer material. For example, the thickness of the IDZ can be increased to a point at which local or point ignition of the multilayer structure does not occur, but bulk ignition by shock initiation is possible. Exothermic multilayer structures can thus be fabricated that can be bulk initiated by shock or impact loading but not by localized thermal or spark initiation.

The following examples are intended to illustrate various aspects of the present invention, and are not intended to limit the scope of the invention.

EXAMPLE 1

Samples comprising Ni/Al multilayers on copper cones were made. The multilayers were applied using a Magnetron sputtering process. This process is done in a vacuum chamber (<10-5 Torr) using sputter guns, plasma formation and large electrical potentials to dislodge atoms from a target material and deposit them on the substrate. The process occurs on the atomic level and deposition rates are influenced by factors such as applied voltage, distance from sputter target, substrate orientation, vacuum, etc. For this series of tests, alloys AA-1100 (99% Al) and Inconel 625 (61 Ni-22 Cr-2.5 Fe-9 Mo) were used as target materials.

Al/Ni coatings were formed on conical copper liners, and monolithic Al/Ni cones were formed on a mandrel and removed. However, as the coating trials progressed, it became evident that slow sputtering rates were associated with the latter. The time required to the requisite 0.048-inch thickness would have been long. Therefore, the efforts focused on coating copper backing liners. These liners were fabricated using wall thicknesses of approximately 0.024-inch. The half-thickness liners were mounted on a rotational device driven by a toothed ring at the base of the vacuum chamber. The liner was placed on a solid, copper mandrel, designed to closely conform to the inside dimensions of the cone. During rotation, the mandrel was in constant contact with a water-cooled, copper base plate. This configuration allowed cooling of the liner during the coating operations. In order to prevent diffusion and formation of unwanted nickel aluminides during sputtering, a stainless steel shield was installed to mask each side of the cone.

A low sputter gun power (40-50 W) was used in order to prevent heat build up. This resulted in relatively low deposition rates. Other coating efforts, with larger substrates, show that power levels of 250 W and continuous run times of 8 hours are achievable. The rotating device was dismantled and ultrasonically cleaned a number of times to remove any traces of oil, grease or other contamination from crevices, holes and fasteners. In addition, stainless steel sheet was formed and placed over the frame to thermally insulate it and a conductive epoxy was used between the copper liner and mandrel for more efficient heat transfer. Sample TSS-3 was run for a total of 16 hours at 150 W on both sputter guns. At the end of this period, total coating thickness was 0.006-0.011 inch. The thickness varied slightly depending on location and this is believed to result from the slight gun-substrate standoff distance between the top and bottom of the cone.

After fabrication, steel containers were filled with a quantity of A-5 high explosive and the conical liners were pressed into the explosive. A critical factor in shaped charge fabrication is maintaining the axial alignment of the container, liner, detonator and explosive charge. Symmetry around the centerline is required to form a penetration jet of the proper shape and density. Pressing parameters (density, pressure, alignment tolerance, etc.) for these tests conformed to standard industry practice for copper liners.

Each shaped charge was tested to determine its ability to penetrate mild steel plate. Before each test, the underlying ground was leveled and a 12×12×1-inch thick base plate was situated. Several steel target plates, 8×8×1-inch thick, were stacked on the base and checked for level. The detonation assembly was mounted, leveled and taped in place. The results of testing are shown in Table 2.

TABLE 2

Figure 8:
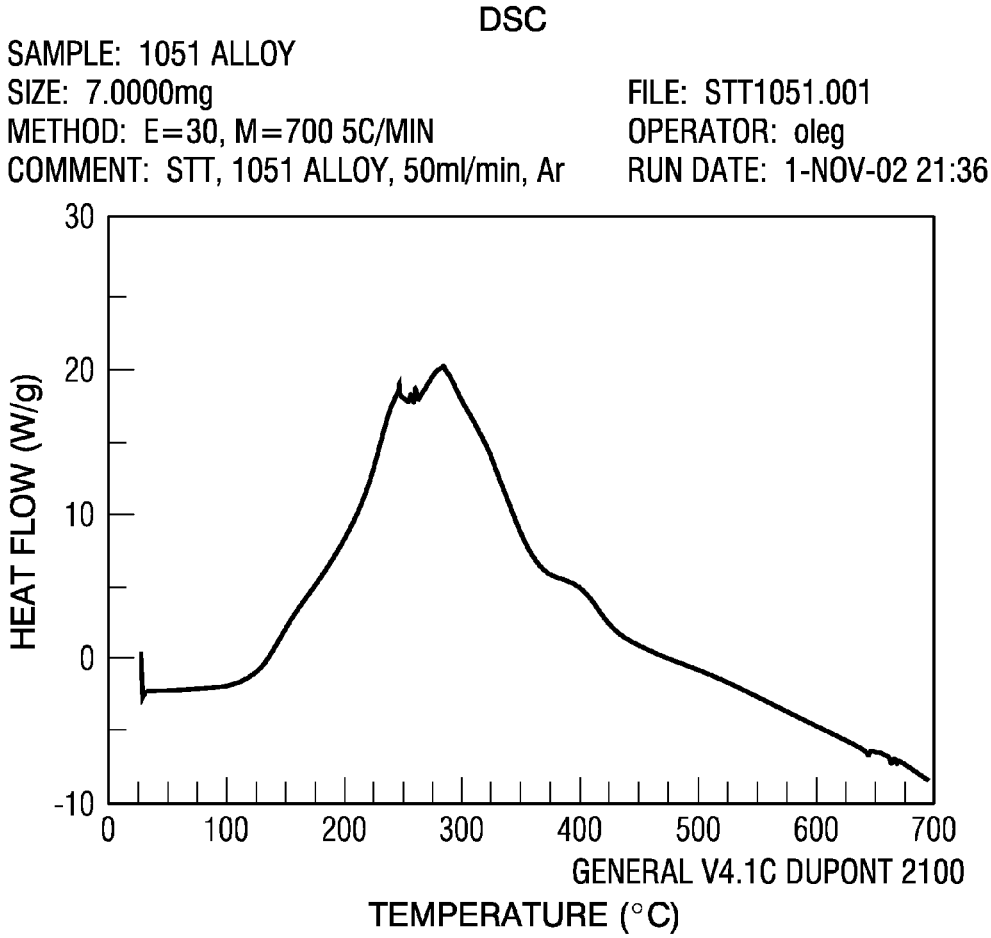

| Sample ID | Sample Type | Explosive Weight (g) | Penetration Depth (in) | Entrance Hole Diameter (in) | Comments |
|---|---|---|---|---|---|
| TSS-1 | Sputtered Ni/Al coating on copper liner | 50.79 | 4.25 | 0.50 | Bright flash, ragged entrance hole with evidence of burning |
| TSS-2 | Sputtered Ni/Al coating on copper liner | 50.69 | 3 | 0.50 | Bright flash, "figure-8" entrance hole with evidence of burning |
| TSS-3 | Sputtered Ni/Al coating on copper liner | 50.15 | 5+ | 0.50 | Similar to TSS-1, solid portion of jet found in plate #6 |

EXAMPLE 2

Two alloy systems were selected: nickel-aluminum and tantalum-aluminum. Two-inch cathodes (one of Ni and one of Al) are positioned in opposite directions, at a 2 inch distance from the substrate holder (drum), which rotates at an adjustable speed. The substrates to be deposited on are positioned on the rotating drum, and moved past each target sequentially. This allows deposition of the desired number of bi-layers, and desired total foil thickness, as determined by rotation speed, selected deposition rate, and total run time.

To establish predictable deposition rates for the materials, deposition onto precision gage blocks was made. This was done with one segment covered, that when removed after deposition left a sharp "step" from the gage block surface to the top of the deposited material. This was measured using a high sensitivity lever gage indicator with submicron resolution. Gage blocks were held on the substrate holder at a distance of 3 inches from source to substrate (target).

This was accomplished by starting with Al sputtered at a 12 W/in$^2$ DC power density for 30 minutes duration and rotation speed of the drum of 2 PRM. Multiple runs of the same parameters resulted in consistent measurements of thickness that could then be related to an estimate of predictable layer thickness per pass (of the drum past the ingot source) for each alloy. This rate was 0.75 for Al settings which related to a build-up of approximately 12 nm per pass of the substrate. The same process was repeated with Inconel for the nickel component, and a set of rates was established for this alloy. Nickel parameters included a higher power density setting of 14 W/in$^2$, with rotation and time the same for the calibration runs and yielded a deposition rate of 9 nm per pass. All work is done under Ar atmosphere of 3 milliTorr.

The sputter cathodes allow fast change-out of the source material, for easy target changes, and use of a variety of alternate materials combinations when desired. The sputter cathodes are equipped with high strength magnets (rare earth type magnets), which can be arranged in a number of magnetic field configurations. Also, the small source size, each coupled with a 500 W DC power capability, gives the ability to use a sputter power density up to 150 W per square inch. This high power density, coupled with the higher strength magnetic field, (and therefore higher plasma density) results in significant increase in sputter deposition rates, which is important with deposition of magnetic materials like Inconel.

Also, a motor controller with adjustable speed control was installed on the deposition system. This allowed for control of the individual layer thickness comprising the multilayers by setting and holding consistent drum rotation speeds. Layer thickness is controlled by power density and rotation speed of the drum holding the "targets".

Once the system was set-up and equipment calibrated, several runs of samples were produced to record and understand the impact of power density, rotation speed, cooling cycle of samples between deposition layers, and impact of substrate on the multi-layer properties. Higher sputter deposition power was feasible with the equipment upgrades, so additional calibration process runs were completed.

Another calibration processing was completed using a silicon wafer for the base substrate masked by a coverslide to create the "step" differential thickness that when removed provided a clean interface to measure the thickness of the deposited layer on the substrate. Drum rotation speeds were varied between 45 seconds/revolution and 73 seconds/revolution.

The impact of varying the substrate, onto which the multi-layers were deposited, was evaluated by comparing DSC results. Substrates used included glass, aluminum foil, and copper foil. Parameter development work also revealed that a cooling cycle of 5 minutes between deposition layers was beneficial for reducing the diffusion of multiple layers together. Diffusion of the two elements would reduce the reactivity of the multi-layer.

Final parameters were established to be 200 W for nickel alloy, 250 W for aluminum, drum rotation rate of 73 seconds/revolution onto copper foil substrates. These parameters produced consistent alternating layers of 7.5 nm of nickel and 7.5 nm of aluminum totaling 17 microns thick in final form.

The processing parameters for Ta—Al were established using the same approach as for the Ni—Al system. Calibration methods were utilized to determine a rate of deposition of tantalum. Preliminary PVD runs were made of Ta/Al multilayer foils, using power settings of 300 W/200 W, respectively. To expedite the processing of initial Ta/Al multilayers for DSC evaluation and reactive initiation properties, calibration data obtained for the previous Ni/Al deposition, in conjunction with sputter gun manufacturer's data on relative deposition rates of various metals, the initial multilayers were deposited with an estimated bilayer thickness of 5 nm/7.5 nm Cooling cycles were incorporated into the process to allow approximately 5 min target off per each hour of run time, to insure adequate substrate cooling during sample deposition. Tantalum deposition still resulted in more heat generation, and therefore higher substrate temperature, during deposition as compared to either Al or Ni processing. Substrate rotation speed of 0.8 rev/min (73 sec per drum revolution) was again used for the initial multi-layer sample deposition. Copper foil substrates, 3"×7"×25 mil thickness were used. Deposition was conducted for a total run time of 4 hours, after which the multi-layer Ta/Al foil material was removed by flexing the copper substrate to cause delamination. Initiation of the foil was initiated with a butane lighter flame. Vigorous initiation of this material was observed, with a white shade of visible light given off, compared to the orange characteristic light present in initiation of Ni/Al multilayer foils.

Greater substrate heating was present in the Ta deposition, presumably due to less sputtered material per Watt input to the sputter gun, as well as tantalum's thermal properties resulting in a higher temperature at the sputter target surface. This effect resulted in two distinct deposition zones on the coated copper substrate, with a more vigorous initiation given by the outer "cool" zone as compared to the center "hot" zone, which may have partially inter-diffused during deposition. Samples of material from each zone is currently underwent DSC analysis.

Using the parameters established in the calibration and optimization runs, multiple samples were produced for the initiation testing. Repeating equal layers of aluminum and Inconel (7.5 nm/layer) were deposited onto copper foil substrates that were approximately 6" tall×10" wide×25 mils thick. A grid was established on the copper sheet using high-temperature, vacuum-compatible tape (Kapton tape/silicone adhesive) to create rectangles of multi-layer foil approximately 1"×2" in size for the initiation testing. After processing, reactive foils with even alternating layers resulted in 17 mm thick foils for initiation testing.

Differential scanning calorimetry (DSC) was performed on freestanding multi-layer material (material removed from substrate prior to DSC run). This analysis measured heat flow as a function of scan temperature of several milligrams of each of the multi-layer sample materials. Specimens were subjected to a heating cycle that ramped from ambient temperature up to 700° C. at a scan rate of 5 deg/min. Relatively large exothermic peaks were noted at scan temperature from 200 to 300° C., with a double peak evolving in some of the scans.

The sharp peak indicates a rapid increase in heat flow indicating initiation of the exothermic reaction. Sharp peaks represent fast reaction propagation, while wider peaks, are indicative of a slower moving reaction.

Figure 5:
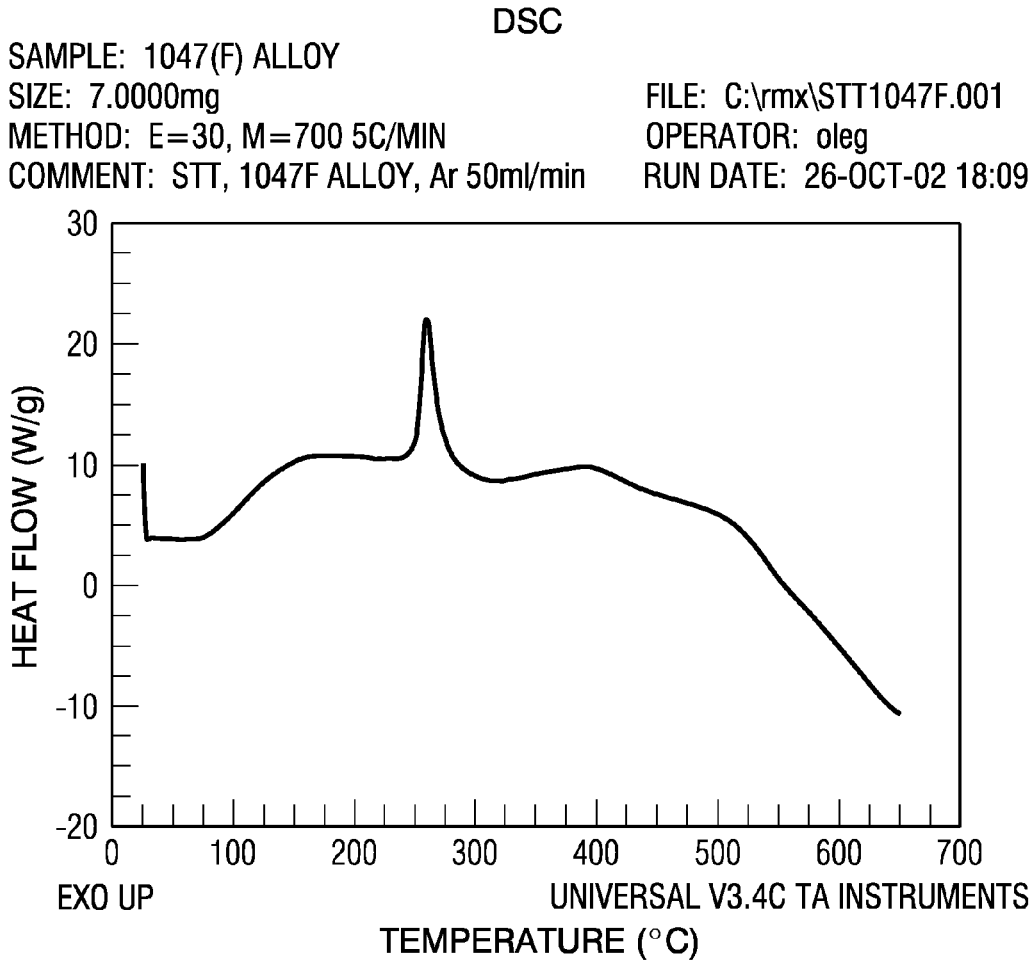
FIGS. 5-10 are differential scanning calorimetry (DSC) scans of various reactive multilayer structures during reaction thereof.
Figure 6:
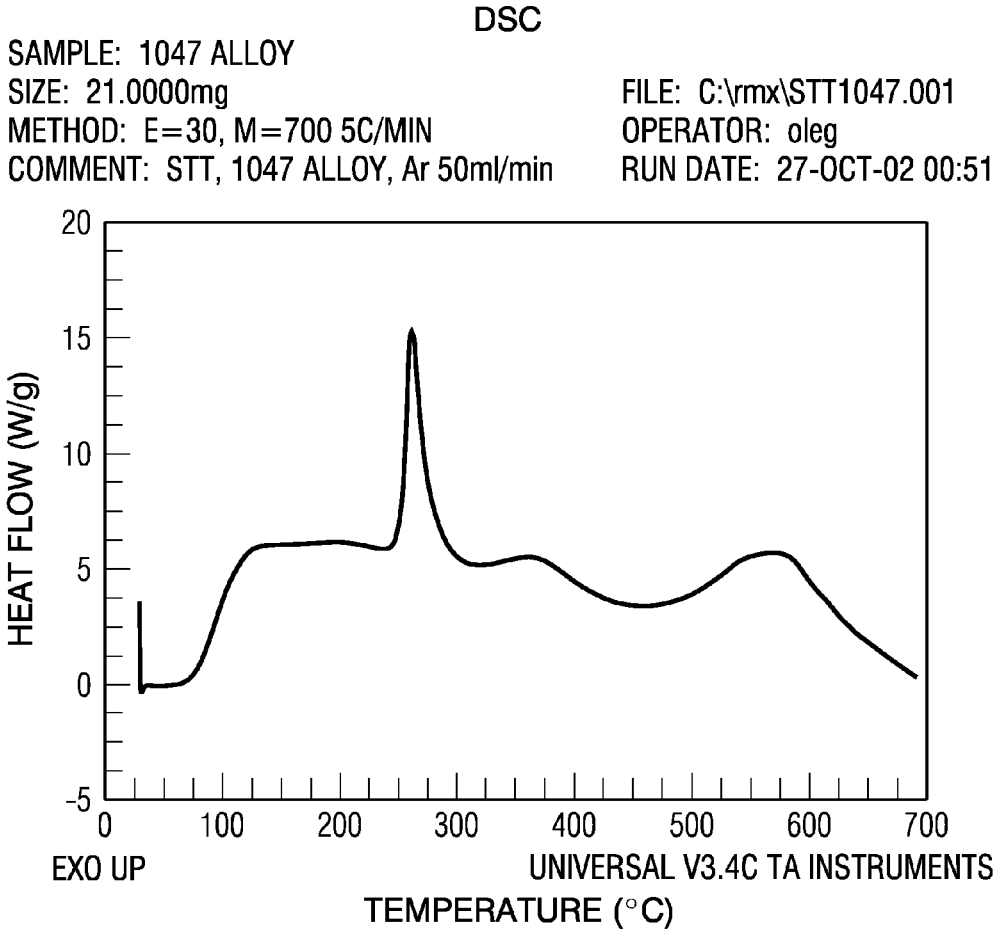
Figure 7:
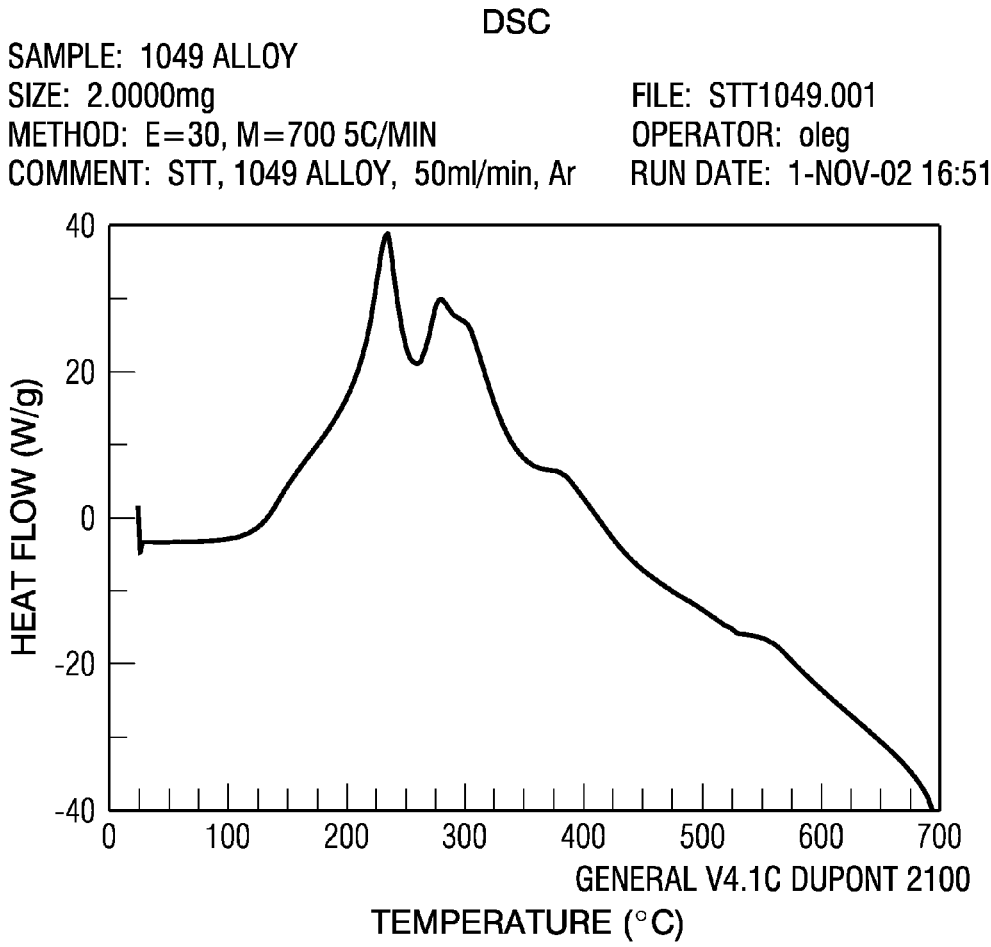

For the Ni—Al foils, DSC results were collected for multi-layer foils deposited on glass, foil and copper substrates. FIGS. 5-8 show DSC scans for the Ni—Al foils. FIG. 5 is a DSC scan of Ni—Al on the foil substrate. FIG. 6 is a DSC scan of Ni—Al on a glass substrate. FIG. 7 is a DSC scan of a sample with relatively thick bi-layers of Al, resulting in more total heat output. FIG. 8 is a DSC scan of Ni—Al produced with a slower rotation speed, resulting in lower heat output possibly due to greater heating of the sample during deposition of the multilayers resulting in more interdiffusion between the layers. The DSC results varied with this possibly indicating the heat-sink effect of a metallic substrate is preferable to the insulating effect of a glass substrate for making these reactive foils. Also, a scan with proportionally richer aluminum layers exhibited a different exotherm peak than the sharp spike typical of the other foils.

Figure 9:
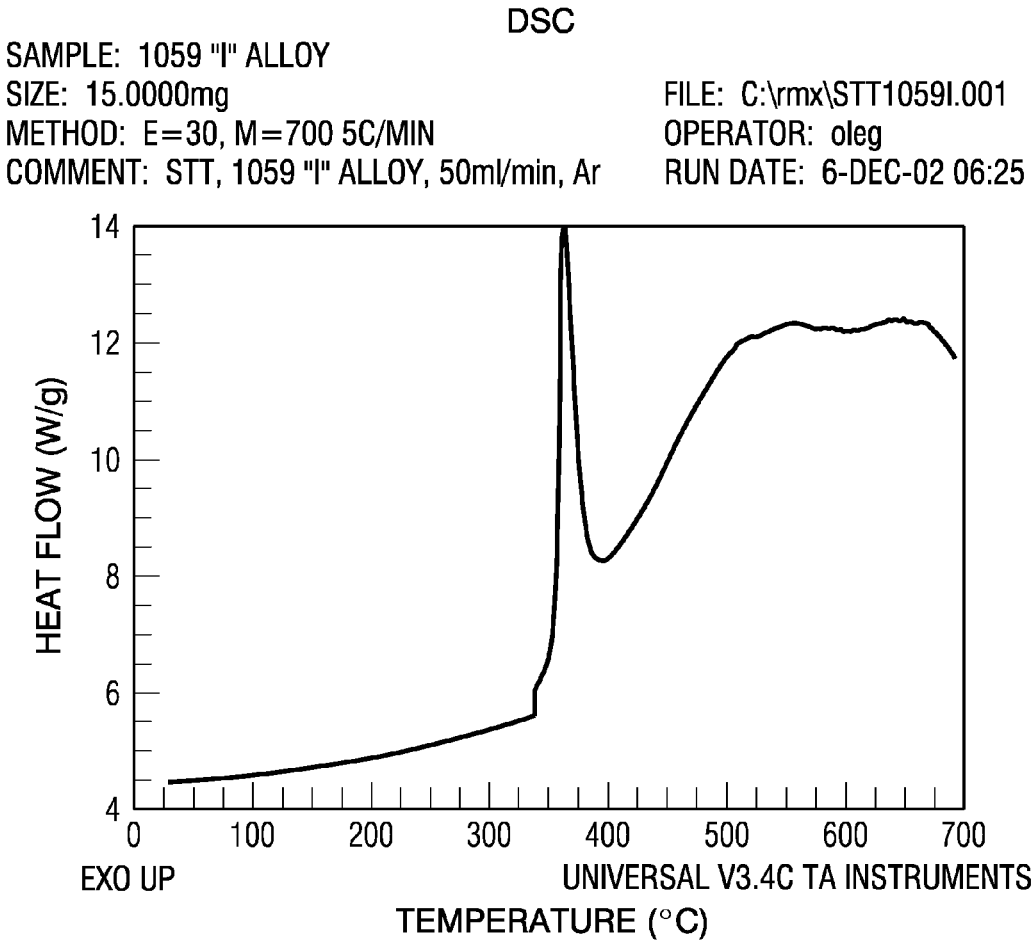
Figure 10:
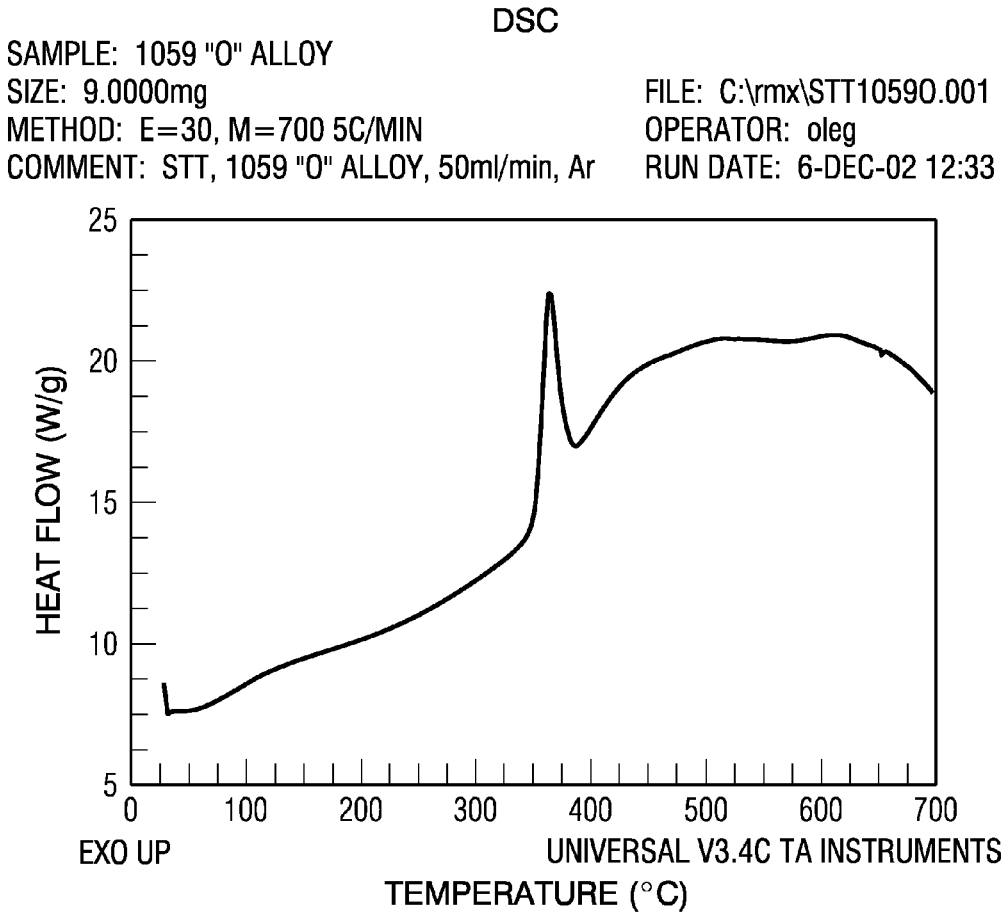

The Ta—Al DSC scans showed a higher peak for the reaction than the Ni—Al scans. FIG. 9 is a DSC scan of the Ta—Al multilayer structure from an inner region of the deposited material. FIG. 10 is a DSC scan for the Ta—Al multilayer from an outer region of the deposited material. There appeared to be differences in the outer and inner regions of the deposited target area. DSC runs were completed on materials from these areas and in fact do exhibit different behavior.

The slightly greater peak height seen in the "outer" region could be a result of more efficient cooling of that area versus the "inner" region during deposition. More efficient cooling leaves less chance of inter-diffusion of the layers that can impact the exothermic reaction.

Testing was conducted on foils composed of nickel and aluminum layers with the objective of documenting various levels of thermal and pulsed energy sources that would cause initiation of an exothermic reaction. Foils were exposed to standard matches, electric matches, igniter, and two power levels of EBW detonators. Results showed that foils of nickel and aluminum multi-layers materials initiated a reaction from the thermal and energetic sources. Foils well bonded to a copper substrate are not initiated by the thermal input from a match, but they are initiated by sparks form an electric match and shock from a detonator.

Testing was completed at a ballistic testing laboratory on an indoor range. Foils of layered material were adhered to a steel plate and the various initiation sources were mounted at specific stand-off distances from the foils. These stand-offs were established in related testing and were selected to ensure samples were not destroyed, but still exposed to the energy sources. A flash detector was used to trigger capture of a gated video still image of the exothermic reaction.

Foils tested included samples where the foil was backed by copper plate, which is the condition these samples were manufactured. Foils were also tested that were removed from the copper backing and were placed against the steel backing plate and secured by tape.

For each initiation source, a still photo of the detonation action of the source only (no foil in place) was taken to test instrumentation and also to document any flash and debris attributed directly to the detonation. For further comparison, "before" firing images were recorded on the foil set-up prior to initiation of the initiation sources.

SQ-80 igniters contain 450 mg of a Thermite mix. RP-3 detonators have a small amount of explosive (30 mg of PETN) and are generally used for situations where minimum fragmenting debris is desired. The RP-501 detonator is a general-purpose "higher energy" explosive containing 136 mg PETN for initiation with 227 mg RDX with binder for output explosive.

Table 3 below shows data recorded for each test. Each initiation source was attempted twice on copper backed foils, and test sequence was repeated on unbacked foils. Initiation sources included a standard match, electric match, SQ-80 igniter, RP-3 detonator, and RP-501 detonator. There were limited quantities of RP-3 detonators available for testing, so a repeated test was not completed on the foil on copper sample using that detonator.

TABLE 3

Shot-by-Shot Data for Initiation Testing of Layered Foils

| Shot # | Foil Configuration | Initiation Source | Initiation | Comment |
|---|---|---|---|---|
| 1 | Foil on Cu | Match | Yes | A protruding piece of foil not touching the copper initiated the reaction |
| 2 | Foil only | Match | Yes | |
| 3 | Foil on Cu | Match | No | Full contact with flame was made, but no initiation resulted |
| 4 | Foil only | Match | Yes | |
| 5 | Foil on Cu | Electric Match | Yes | Electric match was touching foil surface |
| 6 | Foil on Cu | Electric Match | Yes | Electric match touching foil surface |
| 7 | Foil on Cu | Electric Match | Yes | ½" offset between match and foil surface |
| 8 | Foil only | Electric Match | Yes | ½" offset between match and foil surface |
| 9 | Foil only | Electric Match | Yes | ½" offset between match and foil surface |
| 10 | Foil on Cu | SQ-80 | Yes | 5" stand-off |
| 11 | Foil on Cu | SQ-80 | Yes | 5" stand-off |
| 12 | Foil only | SQ-80 | Yes | 5" stand-off |
| 13 | Foil only | SQ-80 | Yes | 5" stand-off |
| 14 | Foil on Cu | RP-501 | Yes | 6" stand-off |
| 15 | Foil on Cu | RP-501 | Yes | 6" stand-off |
| 16 | Foil only | RP-501 | No | Foil had breaks in surface prior to detonation. |
| 17 | Foil only | RP-501 | No | Foil integrity was good prior to firing, no apparent reaction occurred |
| 18 | Foil on Cu | RP-3 | Yes | ½" stand-off |
| 19 | Foil only | RP-3 | Yes | ½" stand-off - foil in pieces, but appeared to have reacted |
| 20 | Foil only | RP-3 | Yes | ½" stand-off, foil had tape over the front face to hold pieces together. Foil was reacted under the tape along radial lines from impact point. |

In the data, there are some outliers from the general trend of initiation of reactions. Using the standard match, the foils on copper backing did not initiate unless there was a section of foil not contacting the copper backing. In shots 1 and 3 this difference was clearly visible in that shot 1 resulted in a reaction, but shot 3 did not.

The foils subjected to the higher energy RP-501 detonators also did not show conclusive initiation of foils in shots 16 and 17 where the foil only, (no copper backing), were tested. It is believed that the explosive force of the detonation physically separated the foil before any reaction had time to propagate. Foils on copper backing, shots 14 and 15, did successfully result in an exothermic reaction initiating.

This example demonstrates that exothermic reactions were initiated in layered foils using electric matches, igniters and two different energy levels of detonators. Reaction of foil on copper backing was not initiated using a standard match when the foil did not have "cracks". Foils not backed with copper, were initiated using standard matches with flames contacting the surface. Foils that had protruding sections from the plane of the foil, and were therefore separated from the copper backing, were ignited using a standard match.

EXAMPLE 3

Repeating equal layers of aluminum and Inconel were deposited onto copper foil substrates that were approximately 6" tall×10" wide×25 mils thick. A grid was established on the copper sheet using high-temperature, vacuum-compatible tape (Kapton tape/silicone adhesive) to create rectangles of multi-layer foil approximately 1"×2" in size for the initiation testing. After processing, reactive foils with even alternating layers resulted in 17 mm thick foils for initiation testing. Very thin 100 micron thick Inconel/Al exothermic multilayer foils fabricated using the magnetron sputter deposition process achieved tensile strengths of 300 Mpa.

Differential scanning calorimetry was performed on free-standing multi-layer material (material removed from substrate prior to DSC run). This analysis measured heat flow as a function of scan temperature of several milligrams of each of the multi-layer sample materials. Specimens were subjected to a heating cycle that ramped from ambient temperature up to 700° C. at a scan rate of 5 deg/min. Relatively large exothermic peaks were noted at scan temperature from 200 to 300° C., with a double peak evolving in some of the scans.

The sharp peak indicates a rapid increase in heat flow indicating initiation of the exothermic reaction. Sharp peaks represent fast reaction propagation, while wider peaks, and hence more energy as defined by the area under the peak, are indicative of a slower moving reaction.

Testing was conducted on nickel-aluminum foils of approximately 1"×1"×17 mm with the objective of determining a boundary for impacts that would cause initiation of an exothermic reaction. Once this range was determined, shots were fired to attempt to capture the time between impact and the start of the exothermic reaction.

Testing was completed at a ballistic testing laboratory on an indoor range. Foils of layered material were used as "targets" against which a 17 grain Fragment Simulating Projectile (FSP) MIL-P-46593A (MU) was fired at varying velocities. Instrumentation was used to capture velocity of the projectile, delay between impact and initiation of the reaction, and still photographs of the impact. Velocities were controlled using initial positioning of the projectile in the barrel and different propellant loading.

Foils tested included samples where the foil was backed by copper plate. Foils were secured to a brass disk about 3" diameter by ¼" thick using tape. This brass disk backing was put in place to eliminate the spark from the projectile hitting the steel backing plate. This insured the flash detector picked up the flash of a reaction initiating. The flash detector was tested using a standard match, which triggered a detection of light. The brass disk was secured to a steel plate in a frame 4.97 meters from the firing barrel. The projectiles passed through two sets of screens triggering chronographs prior to hitting the target. The figures below show the range set-up. After the minimum velocity at which reactions initiated was determined, the set-up was modified slightly to enable capture of the timing between impact and the start of the exothermic reaction. This involved putting a "make" screen on top of the foil to indicate a completed circuit when the projectile contacted it thereby triggering the start of the timing indicator for the sequence of impact to detection of a flash indicating initiation of the foil.

Table 4 below shows the shot-by-shot data recorded for the testing. The initial shots were fired at a range of 4.97 meters from end of firing barrel to the front face of the test foil. To accommodate slower velocities needed to bracket the point of "go/no-go" for the initiation of the exothermic reaction, the target was moved closer to 1.98 m.

The velocity at which foils were ignited by impact ranged from a slowest of 129.6 m/s to the highest of 628.1 m/s. Velocities of 111.4 m/s and 111.6 m/s did not result in initiation of a reaction upon impact. This brackets the velocity to start the reaction between 111.4 m/s and 129.6 m/s. The velocities reported are striking velocities as calculated from actual measurement of the projectile velocity taken while passing through two sets of triggering screens at specified distances.

There was one "outlier" in the data for shot number 22 in which a velocity of 236.8 m/s did not initiate a reaction in the foil. It is not clear why this was the case for this sample. However, in the higher velocity impacts, it was evident that the foils were sometimes separated mechanically (blown apart) from the impact faster than the reaction could propagate from the initial impact site. It is believed this result is an artifact of the testing foil thickness of approximately 17 microns making them fragile and susceptible to cracking during handling for positioning for the testing.

The delay between measure impact and flash detection indicating initiation of a reaction, varied for the four samples on which it was measured. The range of delays was between 210 microseconds and 2028 microseconds. Table 5 below shows this data separately.

TABLE 4

Shot-by-Shot Data for Impact Initiation Testing of Layered Foils

| Shot # | Distance to Target | Velocity (m/s) | Initiation | Comment |
|---|---|---|---|---|
| 1 | 4.57 m | 340.4 | Yes | Steel backer plate |
| 2 | 4.57 m | 557.9 | Yes | Steel backer plate |
| 3 | 4.57 m | 554.9 | N/A | No foil - instrumentation test |
| 4 | 4.57 m | 628.1 | Yes | Steel backer plate |
| 5 | 4.57 m | 337.0 | N/A | No foil - instrumentation test |
| 6 | 4.57 m | 541.1 | N/A | No foil - instrumentation test |
| 7 | 4.57 m | 549.5 | N/A | No foil - instrumentation test |
| 8 | 4.57 m | 338.8 | N/A | No foil - instrumentation test |
| 9 | 4.57 m | 310.0 | Yes | Brass disk mounting started |
| 10 | 4.57 m | 545.0 | Yes | |
| 11 | 4.57 m | 332.0 | Yes | |
| 12 | 4.57 m | 184.2 | N/A | Missed sample |
| 13 | 4.57 m | 170.5 | N/A | Missed sample |
| 14 | 4.57 m | 165.3 | N/A | Missed sample |
| 15 | 1.98 m | 234.3 | Yes | |
| 16 | 1.98 m | 192.4 | Yes | |
| 17 | 1.98 m | 111.4 | No | |
| 18 | 1.98 m | 111.6 | No | |
| 19 | 1.98 m | 129.6 | Yes | |

TABLE 4-continued

Shot-by-Shot Data for Impact Initiation Testing of Layered Foils

| Shot # | Distance to Target | Velocity (m/s) | Initiation | Comment |
|---|---|---|---|---|
| 20 | 1.98 m | 237.9 | Yes | Delay = 1802 microseconds |
| 21 | 1.98 m | 243.9 | N/A | No foil - instrumentation test |
| 22 | 1.98 m | 236.8 | No | Outlier relative to other tests |
| 23 | 1.98 m | 228.2 | Yes | Delay = 2028 microseconds |
| 24 | 1.98 m | 232.9 | Yes | Delay = 1519 microseconds |
| 25 | 1.98 m | 380.7 | Yes | Delay = 210 microseconds |
| 26 | 1.98 m | 377.8 | Yes | Delay = 321 microseconds |
| 27 | 1.98 m | 380.5 | Yes | No flash reading |
| 28 | 1.98 m | 386.8 | Yes | No flash reading |

TABLE 5

Impact to Flash Detection Delay Comparisons

| Shot # | Velocity (m/s) | Delay (microseconds) |
|---|---|---|
| 20 | 237.9 | 1802 |
| 23 | 228.2 | 2028 |
| 24 | 232.9 | 1519 |
| 25 | 380.7 | 210 |
| 26 | 377.8 | 321 |

Impacting bodies at a striking velocity of 129.6 m/s had sufficient energy to initiate an exothermic reaction of layered nickel and aluminum foils 17 microns thick.

Impacting bodies at a striking velocity of 111.5 m/s did not have sufficient energy to initiate an exothermic reaction of layered nickel and aluminum foils 17 microns thick.

At higher velocities (>370 m/s), the integrity of the foil after impact appeared to have an impact on the ability of the exothermic reaction to propagate through the test foil.

The time delay between impact and the detection of the flash indicating initiation of an exothermic reaction varied with the striking velocity of the impacting body. More data would be required to determine the validity of this correlation.

EXAMPLE 4

The sensitivity to initiation of exothermic multilayer structures can be controlled by varying thermal state during deposition. Multilayer structures were deposited on glass, aluminum foil, and copper foil substrates. Parameter development work revealed that a cooling cycle of 5 minutes between deposition layers is also beneficial for reducing the diffusion of multiple layers together. Diffusion of the two elements reduces the reactivity of the multi-layer. Using the parameters established in calibration and optimization runs, multiple samples were produced for the initiation testing. Layers of aluminum (7.5 nm/layer) and Inconel (7.5 nm/layer) were deposited onto substrates. DSC results were collected for Ni—Al multi-layer foils deposited on glass, foil and copper substrates. The DSC results showed that the sensitivity was higher when a thermally conductive metallic substrate was used.

EXAMPLE 5

A water-cooled rotation stage was installed in a PVD system. The sputter guns were re-mounted and oriented so as to deposit onto the rotating cooled mandrel. A stainless steel shield, with a cutout to accommodate the deposition mandrel, was positioned so as to have incident deposition from each sputter source onto separate sides of the mandrel, while rotating. This setup allows for reactive multilayer structures, comprised of alternating layers of two metals, to be deposited onto the mandrel. By varying the rotation speed of the mandrel and the deposition rate of the individual metals, bilayer thickness and the ratio of the two materials can be controlled. The cooled mandrel will insure that interdiffusion between the layers is minimized. Alternatively, by varying the mandrel temperature (by controlling coolant temperature) differing levels of multilayer interdiffusion can be achieved.

Whereas particular embodiments of this invention have been described above for purposes of illustration, it will be evident to those skilled in the art that numerous variations of the details of the present invention may be made without departing from the invention.

The invention claimed is:

1. A shock initiation device comprising: a reactive multilayer structure including repeating layers of reactive components which are capable of subsequently reacting with each other; and explosive means for shock initiation of the reactive multilayer structure, wherein the device is a reactive shaped charge.

2. The shock initiation device of claim 1, wherein one of the reactive components is selected from the group consisting of Ni, Si, Ti, Ta, V, Zr, Nb, W, Mo, Cr, Rh and Ir, and another of the reactive components is selected from the group consisting of Al, Si, Mg, Ni, C and B.

3. The shock initiation device of claim 1, wherein one of the reactive components is selected from the group consisting of $TiO_2$, $Al_2O_3$, $Fe_3O_4$, $SiO_2$ and $NiO_2$, and another of the reactive components is selected from the group consisting of Al, Fe, Ni, $B_2O_3$ and $TiO_2$.

4. The shock initiation device of claim 1, wherein the reactive components are provided in sufficient amounts to form an intermetallic compound upon reaction.

5. The shock initiation device of claim 1, wherein one of the reactive components comprises Ni and another one of the reactive components comprises Al.

6. The shock initiation device of claim 1, wherein the reactive components comprise different metals provided in amounts selected to form a specified intermetallic comprising the metals upon exothermic reaction of the reactive metal components.

7. The shock initiation device of claim 6, wherein the intermetallic comprises nickel aluminide and/or titanium aluminide.

8. The shock initiation device of claim 1, wherein each of the layers has a thickness of from about 10 nanometers to about 1 micron.

9. The shock initiation device of claim 1, wherein the layers of reactive components are directly adjacent each other.

10. The shock initiation device of claim 1, wherein the reactive structure has a porosity of less than about 10 volume percent.

11. The shock initiation device of claim 1, wherein the reactive structure has a tensile yield strength of at least 5 ksi.

12. The shock initiation device of claim 1, wherein the reactive structure is at least partially coated with a fire retardant layer comprising a ceramic.

13. The shock initiation device of claim 1, wherein the reactive structure is at least partially coated with at least one layer of substantially non-reactive mechanically shock resistant rubber or polymer.

14. The shock initiation device of claim 1, wherein the means for shock initiation comprises an explosive.

15. The shock initiation device of claim 1, wherein the means for shock initiation comprises an object which impacts the reactive multilayer structure.

* * * * *